US005662326A

United States Patent [19]

Gebran

[11] Patent Number: 5,662,326

[45] Date of Patent: Sep. 2, 1997

[54] CHESS SET CONSTRUCTION

[75] Inventor: Nagib Gebran, Forest Hills, N.Y.

[73] Assignee: Educational Chess Enterprises, Forest Hills, N.Y.

[21] Appl. No.: 703,062

[22] Filed: Aug. 26, 1996

[51] Int. Cl.[6] ..... A63F 3/02

[52] U.S. Cl. ..... 273/239; 273/260; 273/291

[58] Field of Search ..... 273/239, 242, 273/260, 261, 282.1, 282.2, 288, 291

[56] References Cited

U.S. PATENT DOCUMENTS

| | | | |
|---|---|---|---|
| 361,721 | 4/1887 | Schmitthenner . | |
| 1,605,703 | 11/1926 | Brown . | |
| 2,339,209 | 1/1944 | Vensel | 273/95 |
| 2,511,774 | 6/1950 | Goldsmith | 273/136 |
| 2,665,913 | 1/1954 | Hlavac | 273/239 |
| 2,809,835 | 10/1957 | Berryhill, Jr. | 273/1 |
| 2,819,904 | 1/1958 | Nelson et al. | 273/130 |
| 3,517,935 | 6/1970 | Graham | 273/137 |
| 3,608,904 | 9/1971 | Margetson | 273/137 R |
| 3,677,550 | 7/1972 | Mathers | 273/137 R |
| 3,680,865 | 8/1972 | Davis | 273/137 AE |
| 3,761,092 | 9/1973 | Shieff | 273/131 AD |
| 3,781,013 | 12/1973 | von Meyer | 273/130 B |
| 3,794,326 | 2/1974 | Bialek | 273/131 KC |
| 3,856,309 | 12/1974 | Helfgott | 273/137 R |
| 3,863,928 | 2/1975 | Nelson | 273/136 B |
| 3,863,930 | 2/1975 | Uvanni | 273/137 W |
| 3,881,731 | 5/1975 | Droney | 273/137 R |
| 3,947,040 | 3/1976 | Samuels | 273/137 R |
| 4,005,866 | 2/1977 | Marcil | 273/131 A |
| 4,013,293 | 3/1977 | Hess et al. | 273/131 AD |
| 4,021,042 | 5/1977 | Sweeton | 273/131 AD |
| 4,034,980 | 7/1977 | Sniderman | 273/131 AD |
| 4,095,801 | 6/1978 | Kembar | 273/260 |
| 4,188,035 | 2/1980 | Metzler, Jr. | 273/260 |
| 4,211,411 | 7/1980 | McDaniel et al. | 273/345 |
| 4,299,389 | 11/1981 | Miolo | 273/239 |
| 4,300,768 | 11/1981 | Wechsler | 273/260 |
| 4,326,720 | 4/1982 | Erlich | 273/239 |
| 4,340,232 | 7/1982 | Shaw | 273/260 |
| 4,391,447 | 7/1983 | Dudley | 273/238 |

(List continued on next page.)

FOREIGN PATENT DOCUMENTS

| | | | |
|---|---|---|---|
| 2188850 | 10/1987 | United Kingdom | 273/260 |
| 2254010 | 9/1992 | United Kingdom | 273/239 |
| 1049571 | 11/1996 | United Kingdom . | |

*Primary Examiner*—William E. Stoll

*Attorney, Agent, or Firm*—Steinberg, Raskin & Davidson, P.C.

[57] ABSTRACT

An improvement for a chess set comprising an eight-row by eight-column pattern of sixty four playing squares on a playing surface of a chess game playing board and two sets of visually distinct playing pieces each having eight pawns, two knights, two bishops, two rooks/castles, one queen and one king. A first set of one or more magnets having a North pole and a South pole is arranged in the board underlying the light squares such that the North pole is oriented toward the playing surface. A second set of one or more magnets having a North pole and a South pole is arranged in the board underlying the dark squares such that the South pole is oriented toward the playing surface. A first one of the bishops of each set movable only on the light squares includes a magnet having a North pole and a South pole arranged in conjunction therewith such that the South pole is odented toward the playing surface whereby the first bishops attract to the light squares and are repelled from the dark squares. A second one of the bishops of each set movable only on the dark squares includes a magnet having a North pole and a South pole arranged in conjunction therewith such that the North Pole is oriented toward the playing surface whereby the second bishops attract to the dark squares and are repelled from the light squares. In one particular modified construction, the chess pieces are weighted according to the convention of comparative or exchange value: each pawn weighs one weight unit, each bishop and knight weighs three weight units, each rook weighs five weight units and each queen weighs nine weight units.

19 Claims, 8 Drawing Sheets

U.S. PATENT DOCUMENTS

| | | | |
|---|---|---|---|
| 4,515,371 | 5/1985 | Basevi | 273/260 |
| 4,861,039 | 8/1989 | Phillips et al. | 273/239 |
| 4,981,300 | 1/1991 | Winkler | 273/239 X |
| 5,171,018 | 12/1992 | Zhang | 273/260 |
| 5,197,742 | 3/1993 | Bendit | 273/239 |
| 5,486,004 | 1/1996 | Fogarty | 273/260 |
| 5,490,675 | 2/1996 | Persidsky et al. | 273/239 X |
| 5,503,400 | 4/1996 | Silva | 273/260 |

10
36
34
18
16
1A
30
20
32
14
12
1A
S
N
S
N
S
N 32
38
N
S
40

32
38

N
S
40

FIG. 8
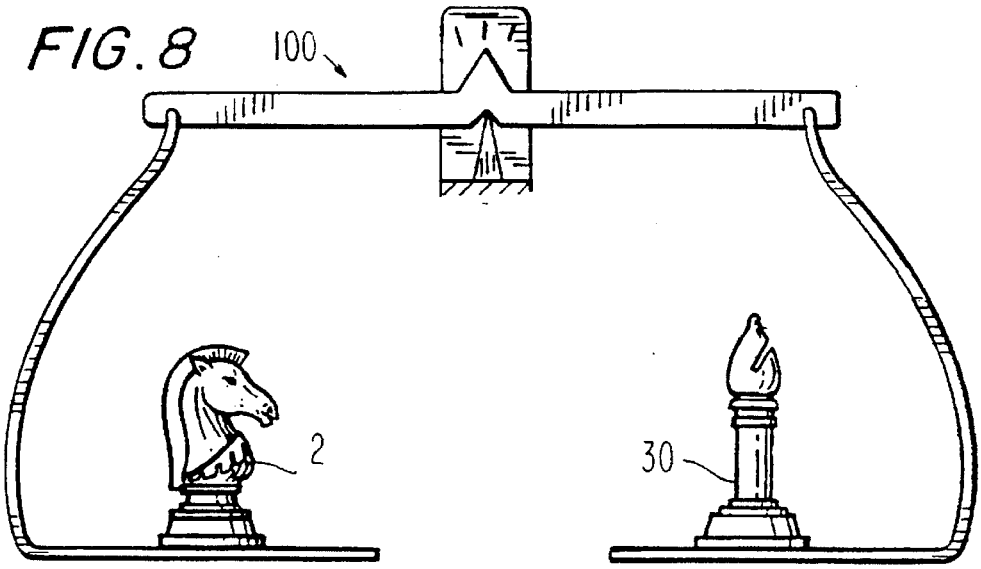
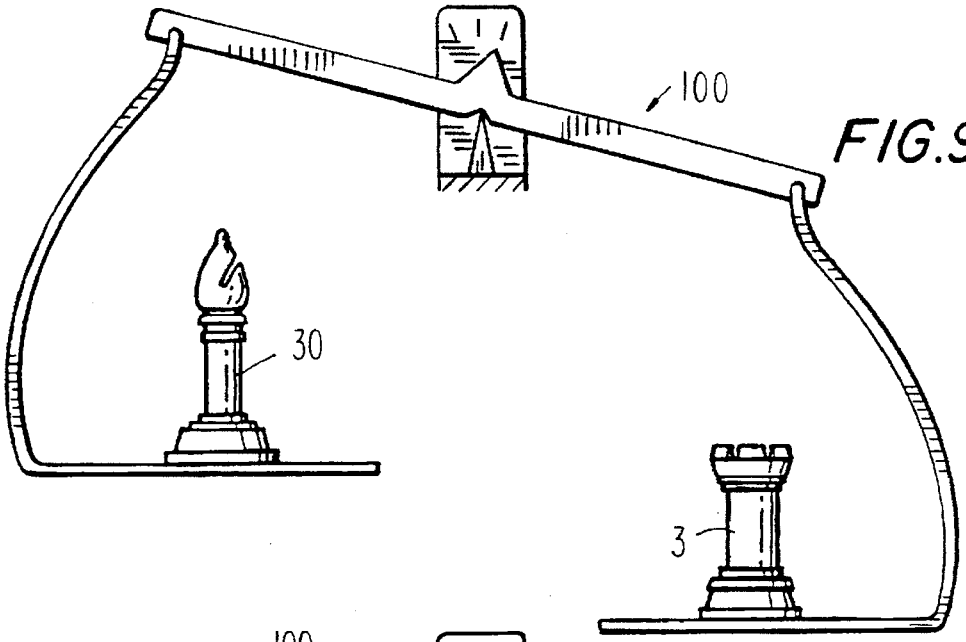
FIG. 9
FIG. 10
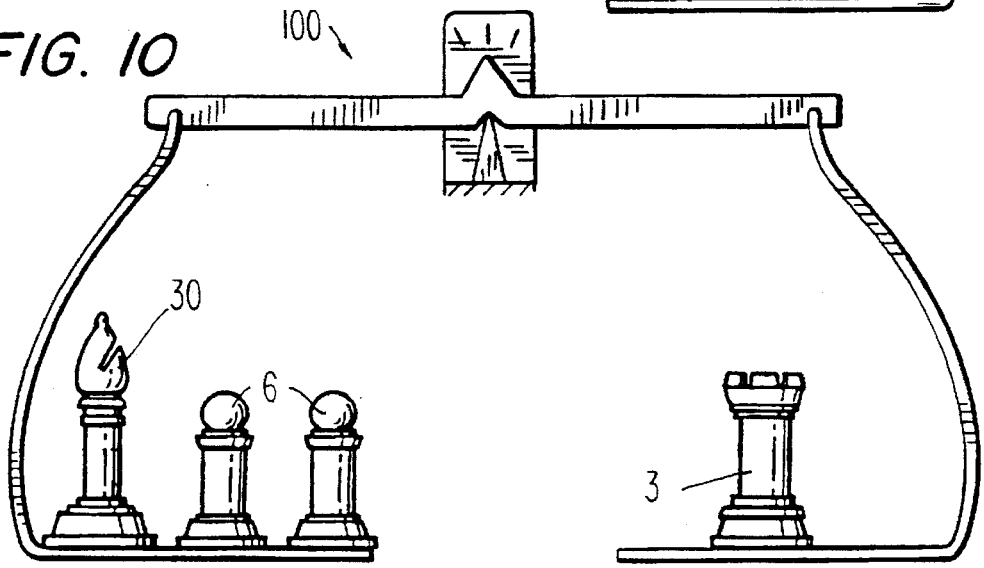

CHESS SET CONSTRUCTION

REFERENCE TO RELATED DOCUMENT

Reference is made to Disclosure Document Number 377299 filed Jun. 28, 1995 by the present applicant.

FIELD OF THE INVENTION

The present invention relates to a magnetic chess board and construction of certain chess pieces having as their primary function the facilitation of the teaching of the game of chess, and as a secondary function to teach certain scientific concepts in an amusing way. More particularly, the present invention relates to a magnetic chess board and magnetic bishop construction which enable the teaching of the proper execution of the bishop move in chess and a specially constructed set of weighted chess pieces which enables the teaching of the relative or comparative value of the chess pieces in accordance with the convention assigning comparative values to chess pieces. In this convention, the queen is worth nine, the rook is worth five, the bishop and knight are each worth three and each pawn is worth one (the king has no exchange value in view of the fact that it is not captured).

With respect to the first aspect, the present invention relates to a specially designed magnetic chess board and magnetized bishops which use the forces of magnetic attraction and repulsion to add accuracy and precision to the teaching of the bishop move, as well as possibly other chess concepts. With respect to the second aspect, the weight of the chess pieces are set relative to each other in accordance with the convention, i.e., the queen weighs nine times the pawn and three times the bishop and knight, so that weights and measures as well as the exchange values of the chess pieces can be taught in connection with each other. These aspects can be used in conjunction with one another to provide a very fun and educational approach to learn the game of chess.

BACKGROUND OF THE INVENTION

Chess is a well-known game and it is becoming immensely popular among school children of all ages especially elementary age students. It is played between two persons with light and dark pieces commonly referred to as the white and black pieces, or any other two sets of visually distinct playing pieces. The white and black sides each possess 16 pieces: one king, one queen, two rooks/castles, two bishops, two knights, and eight pawns. The standard chess board is an eight-row by eight-column pattern of sixty-four playing squares comprising thirty-two light squares and thirty-two dark squares arranged in an alternating light/dark pattern in each of the rows and each of the columns. In order to render chess attractive to educators as well as educationally meaningful to children, it would be ideal to integrate it with other academic disciplines such as science and math.

In chess, the bishop moves in a straight line only along a diagonal from its previous position. At the start of each game, each side possesses two bishops, one arranged on a light square and one arranged on a dark square. The bishop operating on the light squares is referred to as the light-squared bishop and will remain on the light squares until it is captured. The bishop operating on the dark squares is referred to as the dark-squared bishop and will remain on the dark squares throughout the chess game until it is captured. Unfortunately, it is common among beginners, especially children of young ages, to confuse this diagonal bishop move and place a light-squared bishop, which should only rest on a light square throughout the game, on a dark square adjacent to it. This would be an illegal move in the game of chess. Nevertheless, often during a game between children, one unfortunately finds the two bishops of the same side operating on squares having the same color. This indicates an illegal move was made and was not noticed by either player.

Magnetic game boards and magnetic pieces may generally be divided into two groups, namely those which utilize the power of magnetism for the purpose of its holding power, i.e., to center the game pieces on the board and/or to avoid the displacement or tilting of the pieces during travel or any motion whatsoever. Examples of such games include those described in U.S. Pat. Nos. 1,605,703 (Brown), 2,511,774 (Goldsmith), and 4,299,389 (Miolo). The second group of games belongs to those which use the powers of magnetic attraction and repulsion for the purpose of entertainment and to add an element of chance and unpredictability to those games. Examples of such games include those described in U.S. Pat. Nos. 2,339,209 (Vensel), 2,809,835 (Berryhill, Jr.), 2,819,904 (Nelson et al.), 3,680,865 (Davis), 4,005,866 (Marcii), 4,013,293 (Hess), 4,021,042 (Sweeton), 4,034,980 (Sniderman), 4,211,411 (McDaniel et al.) and 4,861,039 (Phillips), and British Patent No. 1,049,571 (Ormerod). As discussed in greater detail below, the present invention differs from all of these prior art games in that it utilizes the powers of magnetic attraction and repulsion for educational and instructional purposes as related to the game of chess.

In the prior art related to teaching chess moves, U.S. Pat. No. 4,391,447 (Dudley) describes a technique for teaching the moves permitted for each piece in a chess game. In this technique, each square on a board has a light which is illuminated with an appropriate color to indicate whether that square is a possible move for a piece. Each square also responds to a piece situated thereon such that by viewing the illuminations of the squares on the board, the permitted moves for each piece can be readily ascertained. This technique requires an elaborate specially constructed board with a plurality of electronic connections between the pieces and the board.

In the prior art related to weighted chess pieces, reference is made to U.S. Pat. No. 361,721 (Schmitthenner). Schmitthenner describes a chess set in which the chess pieces have an ovoid or egg-shaped base and include a sufficiently heavy weight to prevent the chess pieces from falling over by accident or otherwise. The weight may consist of any suitable dense material such as lead or iron. Schmitthenner does not differentiate between the weight to be included in each of the chess pieces.

Reference is also made to U.S. Pat. No. 3,863,930 (Uvanni) which describes a weighted chess piece including a hollow body having a ballast receiving chamber therein. The set of chess pieces can be custom weighted as desired by the user. However, Uvanni does not mention that the chess pieces can be custom weighted according to their relative or comparative value.

Reference is further made to U.S. Pat. No. 4,095,801 (Kembar) which describes a chess set in which the volume of each piece is suggestive of its relative power and the mass of each piece is indicative of the impodance of that piece in the game of chess. Kembar does not mention that the chess pieces can be weighted according to their relative or comparative value in accordance with the convention noted above.

It has also been realized to make the height of the pieces in the chess set indicative of their value, i.e., a taller piece has more value than a shorter piece. A chess set exuding this type of construction is described in U.S. Pat. No. 3,517,935 (Graham). However, the height of the pieces is not numerically related to the exchange value of the piece, e.g., in accordance with the convention of assigned values to chess pieces noted above.

With respect to teaching the relative value of the chess pieces in accordance with the convention of assigned values, U.S. Pat. No. 3,947,040 (Samuels) describes an element having an indicia bearing surface which is removably attached to an annular recess on a base of each chess piece. The indicia bearing surface includes the comparative numerical value of that piece in accordance with the convention, e.g., the number 5 in the illustrated embodiment of a rook.

Reference is also made to U.S. Pat. Nos. 3,781,013 (Von Meyer), 4,326,720 (Erlich), 4,515,371 (Basevi) and 5,502,400 (Silva) which relate to games which apply the principles of magnetism.

OBJECTS AND SUMMARY OF THE INVENTION

It is an object of the present invention to provide a new and improved chess board and chess set to be used in conjunction therewith in connection with which it is possible to facilitate the teaching and proper execution of the bishop move in chess.

It is another object of the present invention to provide a new and improved chess board and chess set to be used in conjunction therewith in connection with which it is possible to integrate the teaching of chess and science.

It is another object of the present invention to provide a new and improved chess board and chess set to be used in conjunction therewith in connection with which it is possible to teach principles of magnetic attraction and repulsion.

It is still another object of the present invention to provide a new and improved chess board and chess set to be used in conjunction therewith in connection with which it is possible to render the game of chess educationally attractive to educators as well as academically meaningful to children.

It is yet another object of the present invention to provide a new and improved chess board and chess set to be used in conjunction therewith in connection with which it is possible to teach chess to children in a scientifically stimulating way.

It is yet a further object of the present invention to provide a new and improved chess board and chess set to be used in conjunction therewith in connection with which it is possible to facilitate the teaching of the range of movement of the kings in a scientifically challenging way in the game of chess.

It is a further object of the present invention to provide a new and improved chess set in connection with which it is possible to teach principles of weights and measures as well as the relative or comparative value of the chess pieces in accordance with the accepted convention.

In order to achieve the objects set forth above and others, the present invention makes use of a chess board having an upper surface defining a grid of sixty-four alternating light and dark squares and embedded with permanent magnets within the chess board with the poles alternately arranged North-South, i.e., the light squares each overlie a magnet with a North polarity facing toward the upper playing surface and the dark squares each overlie a magnet with a South polarity facing toward the upper playing surface such that all the dark squares will be of the same magnetic polarity and all the light squares will be of the same magnetic polarity. The magnetic orientation of the magnets in the board is preferably perpendicular to the upper surface of the board which defines the playing surface. The light and dark squares will therefore possess opposite magnetic polarity from each other. As noted above, the bishop move in chess is restricted to movement in straight lines only along the diagonals. In accordance with the invention, in order to avoid the situation in which the light-squared bishop is inadvertently placed on a dark square and the dark-squared bishop is placed on a light square, or possibly avoid the need for constant supervision by the teacher when children are playing, the bishops are embedded with magnets of opposite polarity. More particularly, the light-squared bishops will be embedded with a magnet having a South polarity oriented toward the playing surface, so that they will magnetically attract to the light squares indicating that a move thereto is permissible and be magnetically repelled from the dark squares indicating that a move thereto is improper, and the dark-squared bishops will be embedded with a magnet with a North polarity facing the playing surface, so that they will magnetically attract to the dark squares and be magnetically repelled from the light squares. Thus, it is not possible to place a dark-squared bishop on a light square since it will not remain thereon, and in fact will be repelled therefrom. This construction of the chess board and bishops serves to teach the bishop move in a scientifically challenging way, i.e., in conjunction with the scientific principles of magnetic attraction and repulsion.

In addition, should an attempt be made to move the dark-squared bishop from one dark square to another dark square. not in a diagonal straight line from the initial position, a repulsion forca will be experienced as this bishop move will have to traverse an opposite colored square, i.e., a square having the same polarity as the bishop, which will repulse the same. Thus, from an initial position, keeping the bishop in close proximity to the board (within a distance over which the magnetic repulsion force between magnets of the same polarity is effective), it will only be possible to move in diagonal straight lines and any other movement would be prevented by the repulsion of the magnet in the bishop to the magnets of the same polarity in the squares adjoining the permissible squares along the diagonal straight lines.

Another common error occurring in the games of beginners and novices is the placement of the king on a square right next to the opposite king. This is an illegal move in the game of chess since the kings must always be separated by at least one square.

To rectify this situation, in accordance with one embodiment of the invention, the kings in a chess set of the present invention are embedded with Vertical rod magnets having the same polarity facing upward, which thus repel one another if placed in close proximity to one another. The magnetic strength of the magnets is such that a repulsion force will be experienced if the kings were to be placed right next to each other. In this manner, the players will be alerted that such a move is not permitted. The vertical rod magnets in the kings are arranged, e.g., such that the North pole faces upward, and have a magnetic strength to repel one another if the kings are placed on adjacent squares.

This embodiment of magnetized kings can be used together with the magnetized bishop construction and associated board or separate therefrom. In order to prevent interference with the magnets in the, board if the kings are used in combination with the magnetized bishops, the magnets in the kings should be placed in the upper portion of the kings so as not to interact with, i.e., be attracted to or repelled from, the magnetic bases of the bishops or the magnet(s) embedded within the board.

In another embodiment of the invention, the playing pieces of the chess set which have an exchange value are weighted in accordance with the convention mentioned above. As such, each pawn has a unit weight of one, each knight and bishop has a weight three times the weight of one of the pawns, each rook has a weight five times the weight of one of the pawns, and each queen has a weight nine times the weight of one of the pawns. As visual stimuli tend to improve retention or memory, by appropriately weighting the chess pieces in this manner, the players can learn the relative exchange value of the pieces, i.e., a bishop weighs the same as a knight and when placed at opposite ends of a balance will achieve an equilibrium state indicating to the students that a trade of a bishop for a knight is an even exchange. On the other hand, a rook weighs more than a bishop and when placed at opposite ends of a balance will not achieve an equilibrium state indicating to the students that a rook has more exchange value than a bishop and a trade would be undesirable for the side losing the rook. In this manner, this chess-piece weighting system can be used to visually teach the relative or comparative value of the chess pieces as well as weights, measures and fundamentals of algebraic equations in conjunction with the game of chess, i.e., an amusing and fun way to learn.

The present invention in general also relates to an arrangement for learning movement of a bishop in the game of chess which comprises a chess board having a playing surface defining at least three rows and at least three columns and including light squares and dark squares arranged in an alternating light/dark pattern in each row and each column. The arrangement includes a first set of at least one magnet having a North pole and a South pole arranged in the board underlying the light squares such that the North pole is oriented toward the playing surface, and a second set of at least one magnet having a North pole and a South pole arranged in the board underlying the dark squares such that the South pole is oriented toward the playing surface, and a first bishop movable only on the light squares including a magnet having a North pole and a South pole arranged in conjunction therewith such that the South pole is oriented toward the playing surface and the first bishop attracts to the light squares and is repelled from the dark squares. To more accurately reflect the game of chess, the arrangement may include a second bishop movable only on the dark squares including a magnet having a North pole and a South pole arranged in conjunction therewith such that the North pole is oriented toward the playing surface and the second bishop attracts to the dark squares and is repelled from the light squares.

BRIEF DESCRIPTION OF THE DRAWINGS

The following drawings are illustrative of embodiments of the invention and are not meant to limit the scope of the invention as encompassed by the claims.

FIG. 8 shows a scale having a knight on one side, a bishop on the other and showing the scale in a balanced position.

FIG. 9 shows a scale having a rook on one side, a bishop on the other and showing the scale in an unbalanced position.

FIG. 10 shows a scale having a bishop and two pawns on one side, a rook on the other and showing the scale in a balanced position.

DETAILED DESCRIPTION OF THE INVENTION

Figure 1:
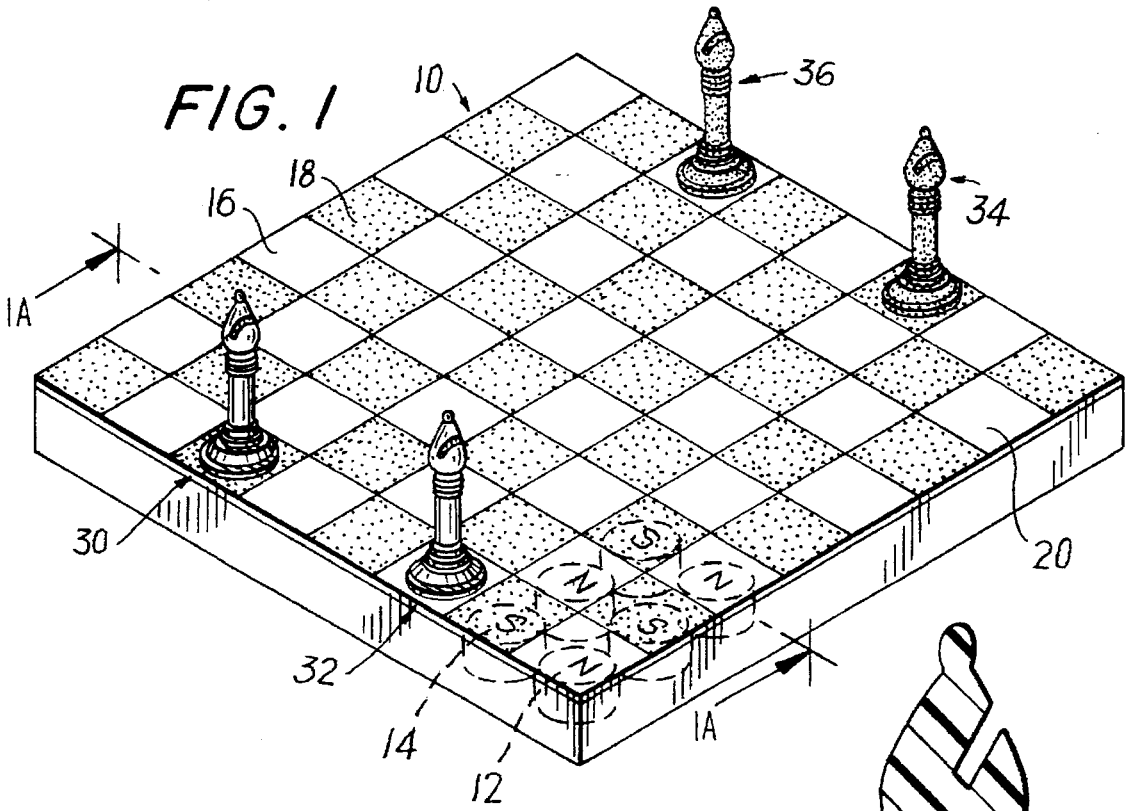
FIG. 1 shows a chess board in accordance with the invention with the light and dark squares denoted as having a North or South polarity and shows the light-squared bishops and dark-squared bishops for each side in the starting position.
Figure 1A:
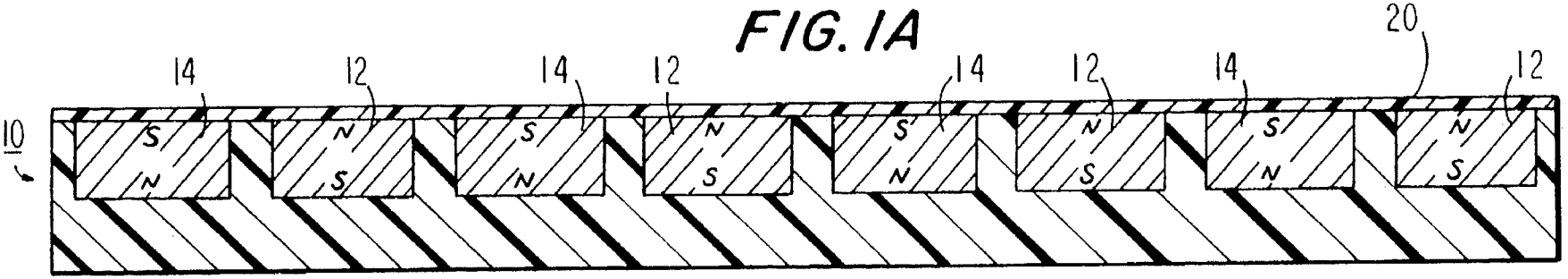
FIG. 1A is a cross-sectional view taken along the line 1A—1A in FIG. 1.

Referring to the accompanying drawings wherein the same reference numerals refer to the same or similar elements, FIG. 1 shows a chess board 10 polarized in accordance with the invention including a planar member 20 having an upper surface defining a conventional chess playing surface or grid of light squares 16 and dark squares 18. In accordance with the invention, the board 10 comprises permanent magnets 12 having a North pole oriented toward the planar member 20 and underlying the light squares 16 and permanent magnets 14 having a South pole oriented toward the planar member 20 and underlying the dark squares 18 (FIG. 1A). Magnets 12,14 can be mounted in a stationary position in the board 10 in a variety of methods, e.g., formed during production of the board so that they are embedded therein.

Figure 1B:
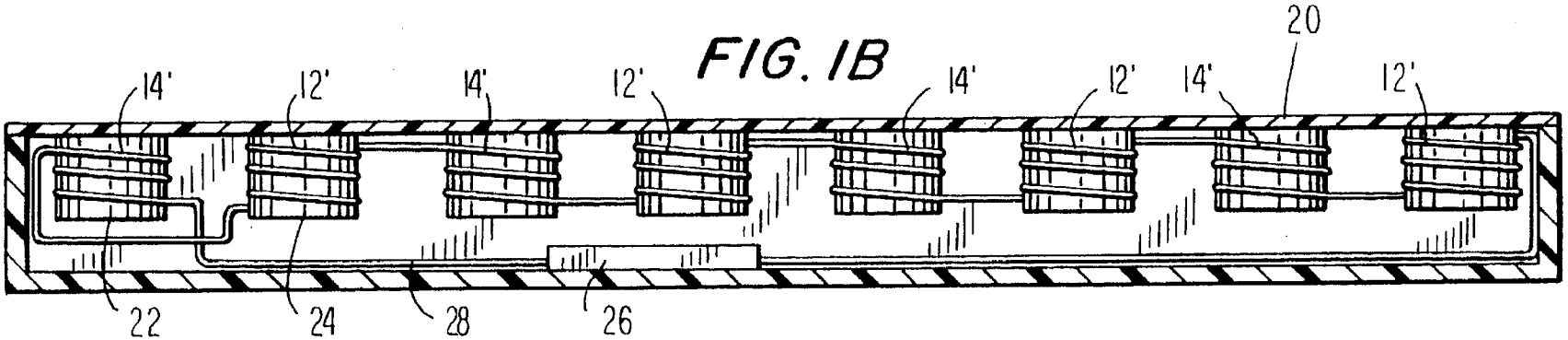
FIG. 1B is another cross-sectional view taken along the line 1A—1A in FIG. 1.

Alternatively, instead of permanently fixed magnets underlying the chess board 10, it is possible to arrange magnetizable members 12', 14' below each of the squares 16, 18 as shown in FIG. 1B and magnetize the same electromagnetically so that during activation, members 12' will have a North pole oriented toward the planar member 20 and members 14' will have a South pole oriented toward the planar member 20. In one embodiment, the electromagnetic system may comprise a battery 26 or other electrical supply means, AC current or DC current, having a wire 28 extending from one terminal to the other terminal. The wire 28 is wound about the members 14' such that the windings 22 thereabout spiral downward in a counterclockwise direction (so as to provide the members 14' with the South pole facing upward in accordance with the left-hand rule). Similarly, the wire 28 is wound about the members 12' such that the windings 24 thereabout spiral upward in a clockwise direction (so as to provide the members 12' with the North pole facing upward). Each member 12',14' could also be independently connected to an electricity supply means and arranged to have the required polarity orientation. Other electromagnetic generator means, such as that disclosed in McDaniel et al., referenced above and incorporated by reference herein, may also be used in connection with the instant invention.

The magnets 12, 14 underlying each respective square 16, 18 in the board may be centrally arranged beneath that square so that a total of sixty-four magnets are required, one underlying each square. Alternatively, it is possible to provide a single permanent magnet or electromagnet for all of the light squares and a single permanent magnet or electromagnet for all of the dark squares, or any number of magnets between 1 and 32 for the light squares and any number of magnets between 1 and 32 for the light squares depending on the construction of the chess board.

Figure 3A:
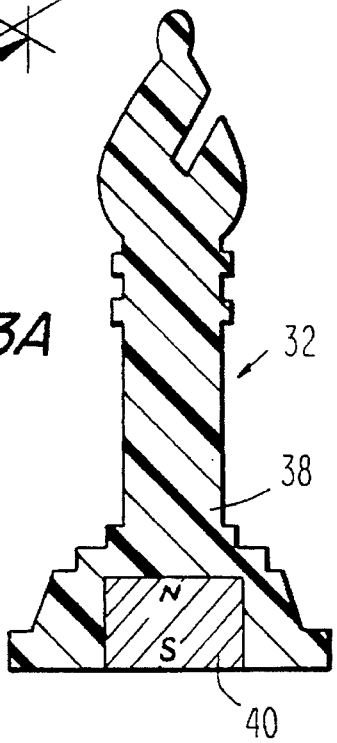
FIG. 3A is a cross-sectional view of a bishop piece in accordance with the invention.
Figure 3B:
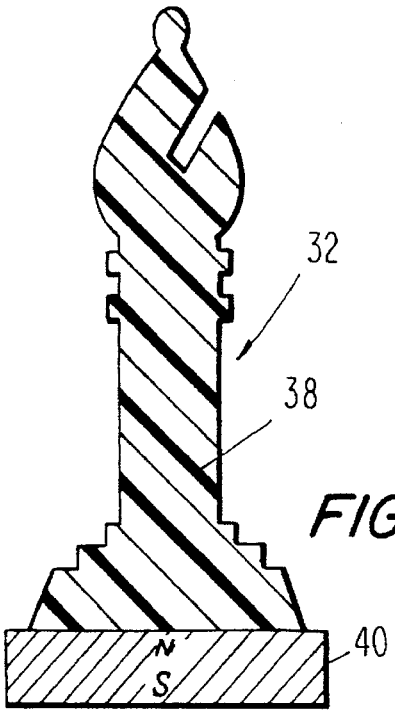
FIG. 3B is another cross-sectional view of a bishop piece in accordance with the invention.
Figure 2:
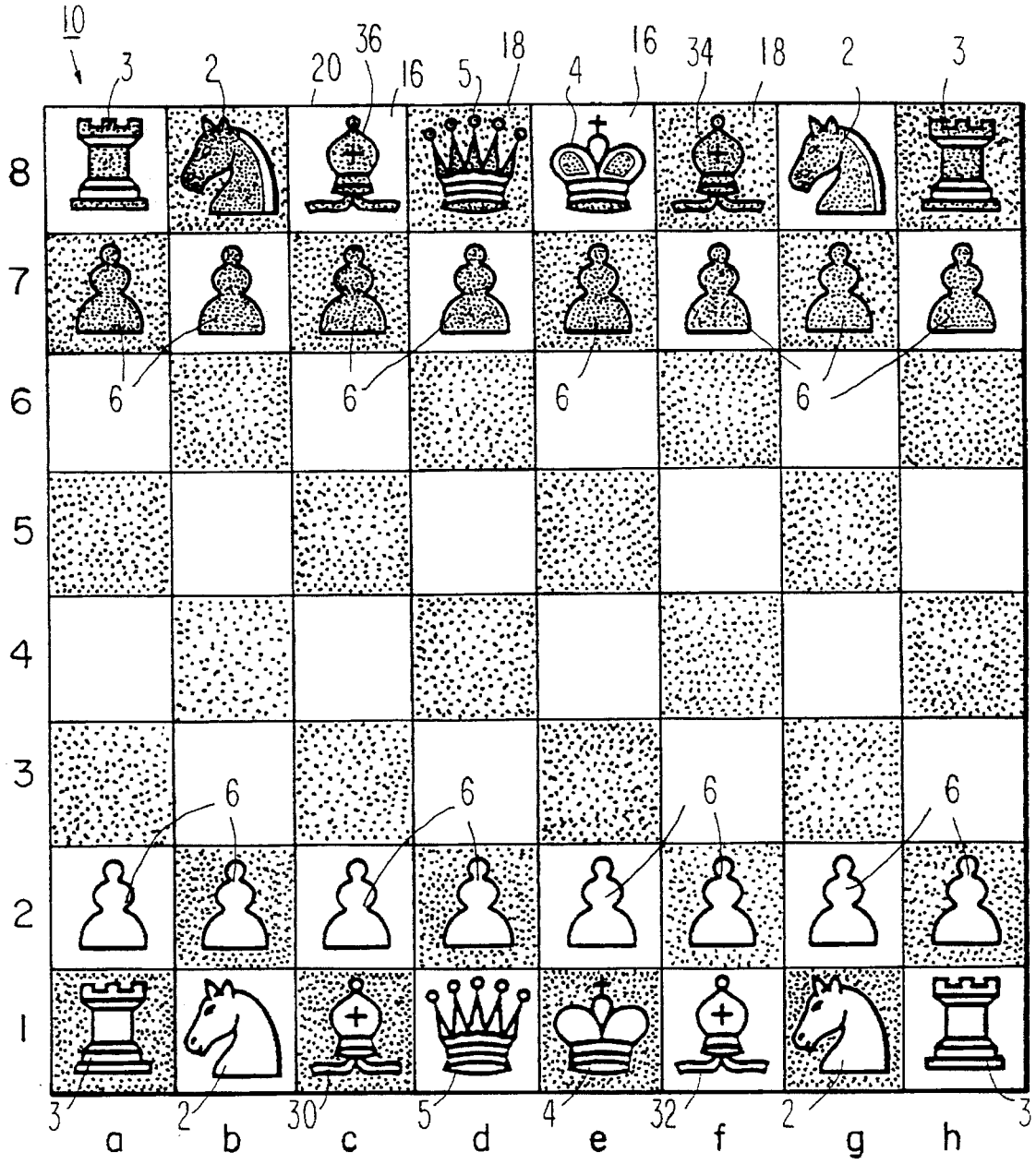
FIG. 2 shows the starting position of the pieces in a game of chess.
Figure 5:
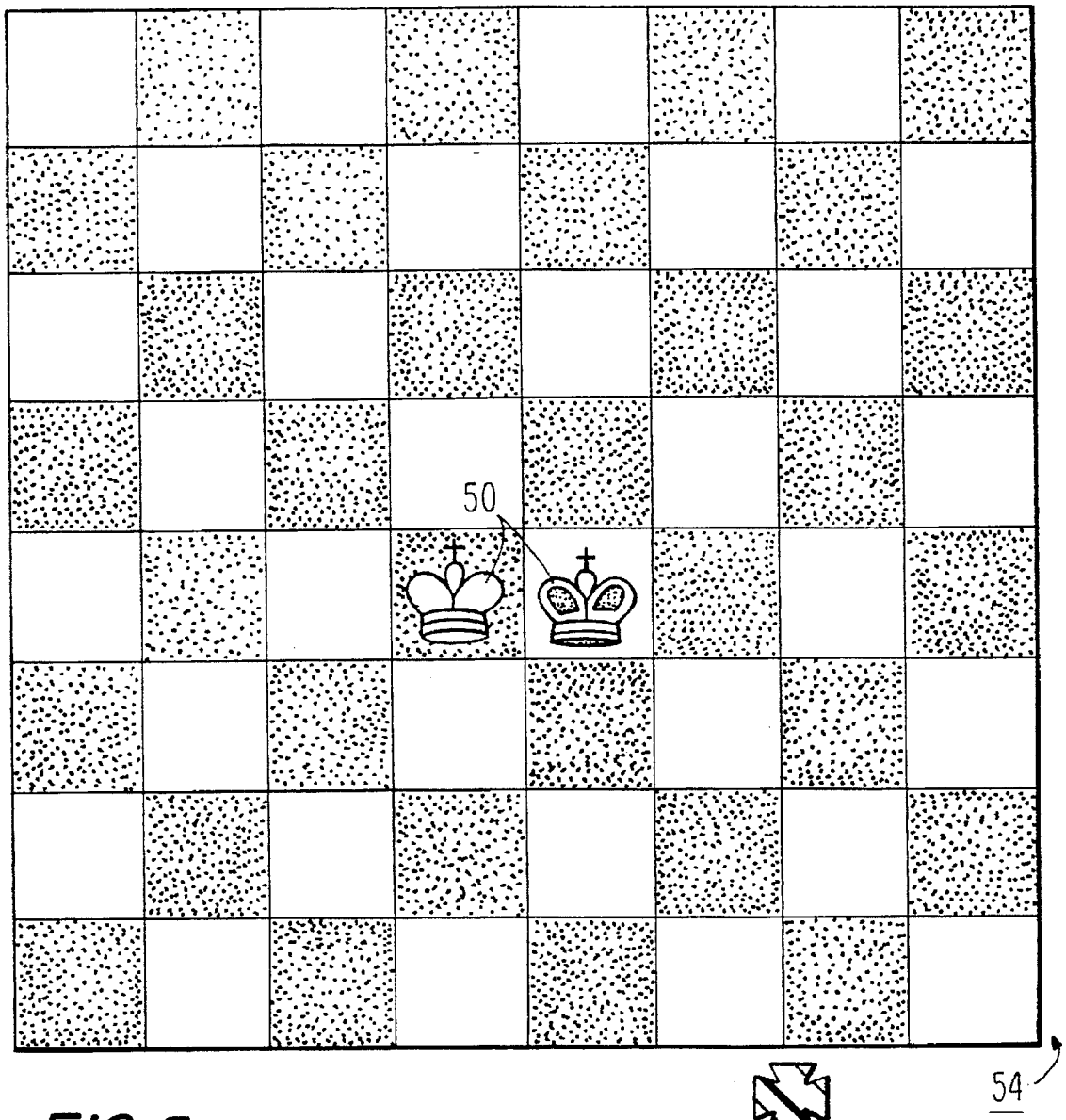
FIG. 5 shows the kings in an illegal position.
Figure 5A:
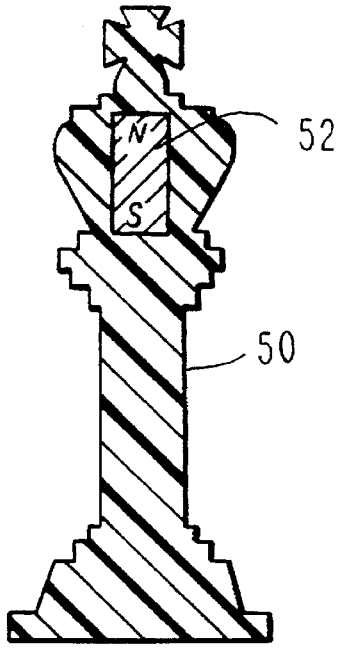
FIG. 5A is a cross-sectional view of a king piece in accordance with the invention.

FIG. 2 shows a set of chess pieces whereby each of the squares 16,18 on the planar member 20 of the board 10 is assigned conventional notations (1–8, a–h). These notations will be used in the description of some embodiments of the invention described below. The queens are designated by reference numeral 5, the kings by reference numeral 4, the rooks/castles by reference numeral 3, the knights by reference numeral 2, the bishops by reference numerals 30,32, 34,36 and the pawns by reference numerals 6. Two-dimensional pieces are shown but it should be understood that these depictions can rapresent three-dimensional pieces, e.g., as shown in FIGS. 3A, 3B and 5A.

In particular, FIGS. 1 and 2 show the bishops 30,32,34,36 of the chess set in their standard starting position positioned on the board 10 in accordance with the invention. Bishop 30 is the light side's dark-squared bishop, bishop 32 is the light side's light-squared bishop, bishop 34 is the dark side's dark-squared bishop, and bishop 36 is the dark side's light-squared bishop. Each of the bishops 30,32,34,36 is constructed as shown in FIG. 3A, which is a cross-sectional view through a central axis of the bishop, and has a permanent magnet 40 situated in a lower region 38, possibly flush with the lower surface of the bishops 30,32,34,36. In bishops 30 and 34, i.e., the dark-squared bishops which move only on the dark squares which have a South polarity facing in the direction of the planar member 20, the magnet 40 is arranged so that the North pole faces downward and as such, will cause magnetic attraction between the magnet 40 of the bishops and the magnets 14 in the board 10 (underlying the permissible dark squares) and magnetic repulsion between the magnets 40 and the magnets 12 in the board 10 (underlying the forbidden light squares). On the other hand, in bishops 32 and 36, i.e., the light-squared bishops which move only on the light squares which overlie magnets having a North polarity facing in the direction of the planar member 20, the magnet 40 is arranged so that the South pole faces downward and will cause magnetic attraction between the magnet 40 and the magnets 12 in the board 10 (underlying the permissible light squares) and magnetic repulsion between the magnets 40 and the magnets 14 in the board (underlying the forbidden dark squares).

It should be understood that the bishop may be constructed in any shape as desired but, in accordance with the invention, one of the light side's bishops includes a magnet having a North pole facing the bottom thereof (so that it attracts to the squares having a South pole facing upward-the dark squares in the illustrated embodiment) and the other light side's bishop includes a magnet having a South pole facing the bottom thereof (so that it attracts to the squares having a North pole facing upward-the light squares in the illustrated embodiment). The dark side's bishops are similarly constructed. If the bishops are constructed of plastic, then the magnets 40 in the bishops can be embedded in the plastic during formation of the bishops, and should be magnetized prior such embedding. In addition, as shown in FIG. 3B, it is possible to construct the magnets 40 as a plate member and position the same on a bottom surface of each bishop, either removably attached thereto or fixedly attached thereto. Also, the polarity of the squares vis-vis their color, light or dark, in the illustrated embodiment, is not critical to the invention, i.e., the light squares may overlie a magnet having a South pole facing upward while the dark square overlie a magnet having a North pole facing upward. In addition, the bishops may be constructed so that the magnets are removable from interior compartments therein.

Figure 4:
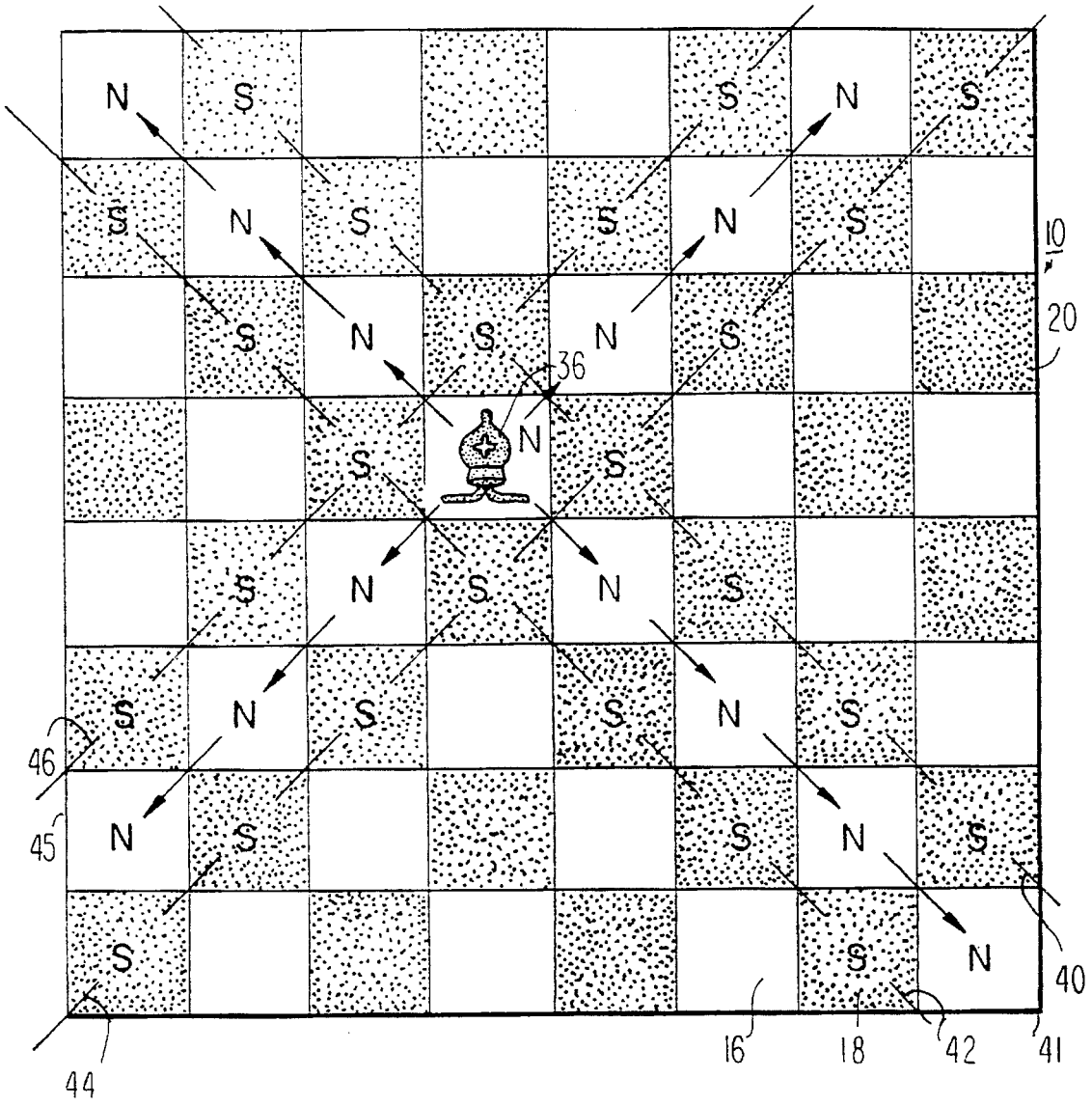
FIG. 4 shows the possible moves of a light-squared bishop along diagonal straight lines.

FIG. 4 shows bishop 36, the dark side's light-squared bishop, on the chess board 10. The possible moves of bishop 36 includes all those squares in a diagonal straight-line, i.e., along lines 41,45 (in the absence of other pieces on the board for the sake of explanation only). All the squares in lines 41 and 45 are light squares 16 whereby a magnet having a North pole facing upward is situated beneath each square. As such, bishop 36 can be moved along the board to any of these squares. However, the bishop 36 cannot be moved to the dark squares 18 in the diagonal lines 40,42,44,46 adjacent to the diagonal lines 41,45. Any attempt by a student or beginner to move the bishop 36 along the board to one of these squares will be prevented by the repulsion force caused by the magnets having a South pole facing upward situated beneath the dark squares 18 which repel the magnet 40 having a South pole facing downward in the bishop 36. Movement of bishop 36 to another light square not in the diagonal lines 41,45 will also be prevented by the repulsion of the magnets underlying the dark squares in lines 40,42, 44,46 provided the bishop 36 is moved along the surface of the board 10.

By means of the chess board and bishops constructed in the manner described above, the movement of the bishop can be learned in conjunction with the principles of magnetic attraction and repulsion.

The remaining pieces of the chess set do not include magnets which would result in repulsion or attraction to the magnets 12,14 situated in the board 10 beneath the planar member 20. This is because the movement of all of the other pieces in chess is not restricted to either dark squares alone or light squares alone.

However, the principles of magnetism can be used to teach the moves of other chess pieces. For example, with reference to FIGS. 5 and 5A in which the board is designated as 54, the kings 50 of both sides can be constructed with a magnet 52 in an upper interior portion thereof. In both kings, the magnet 52 may be a rod magnet wherein the North pole faces upward and the South pole faces downward or vice versa. In this manner, if the kings 50 are placed adjacent one another as shown in FIG. 5, then the kings 50 will be pushed away from one another by the effect of the repulsion force caused by the magnets 52 in the kings 50 having the same polarity.

This construction of the kings can thus be used to teach the magnetic principle of repulsion and can be used independently of the chess set and bishop construction discussed above. It can also be used in conjunction with the chess set and bishop construction discussed above, in which case, the magnets 52 are positioned in an upper portion of the kings 50 so that they are a sufficient distance away from the magnets 12,14 beneath the board and the magnets in the bottom portion of the bishops and do not interact therewith.

Figure 6:
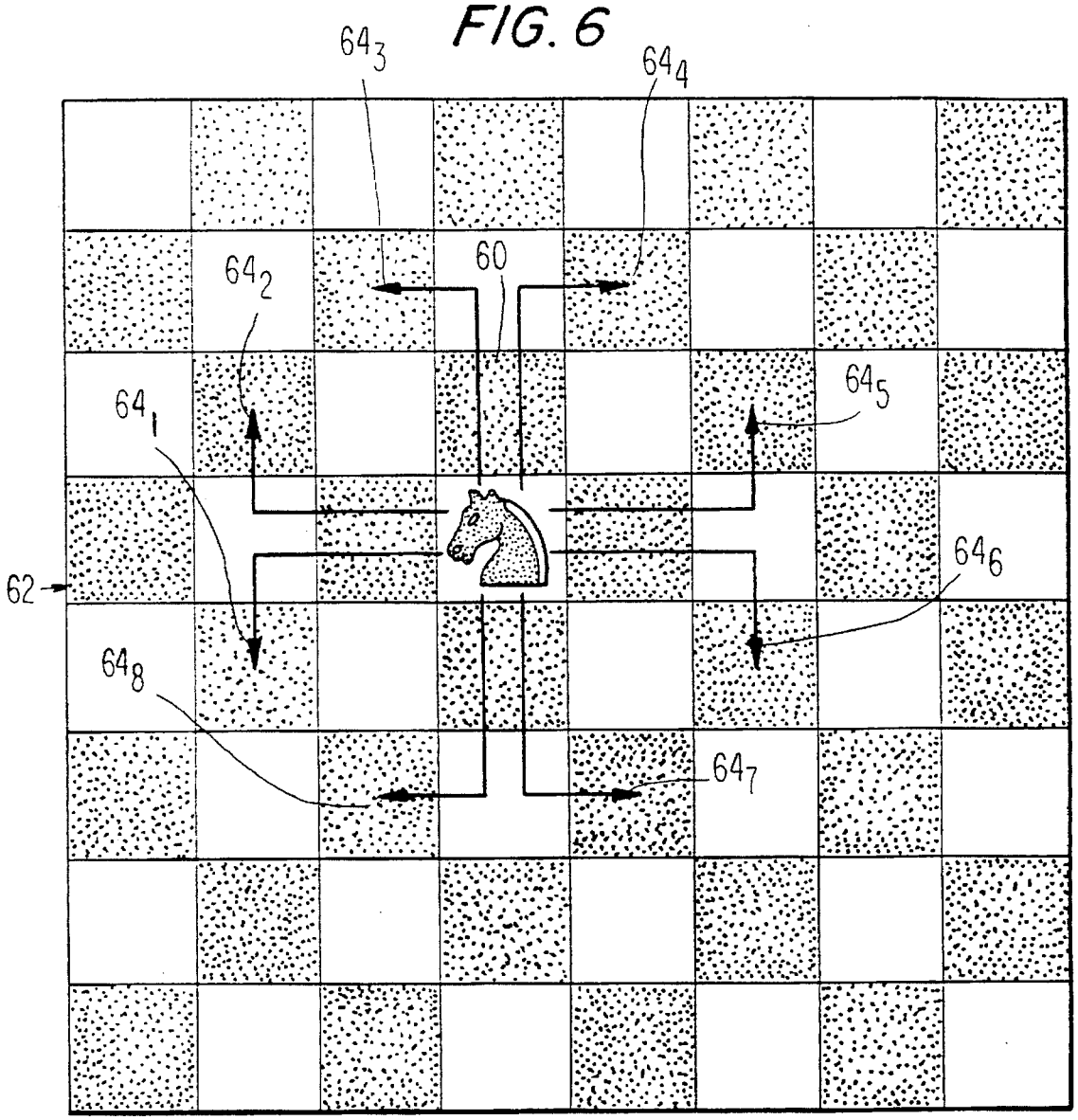
FIG. 6 shows a knight and its possible moves.
Figure 7:
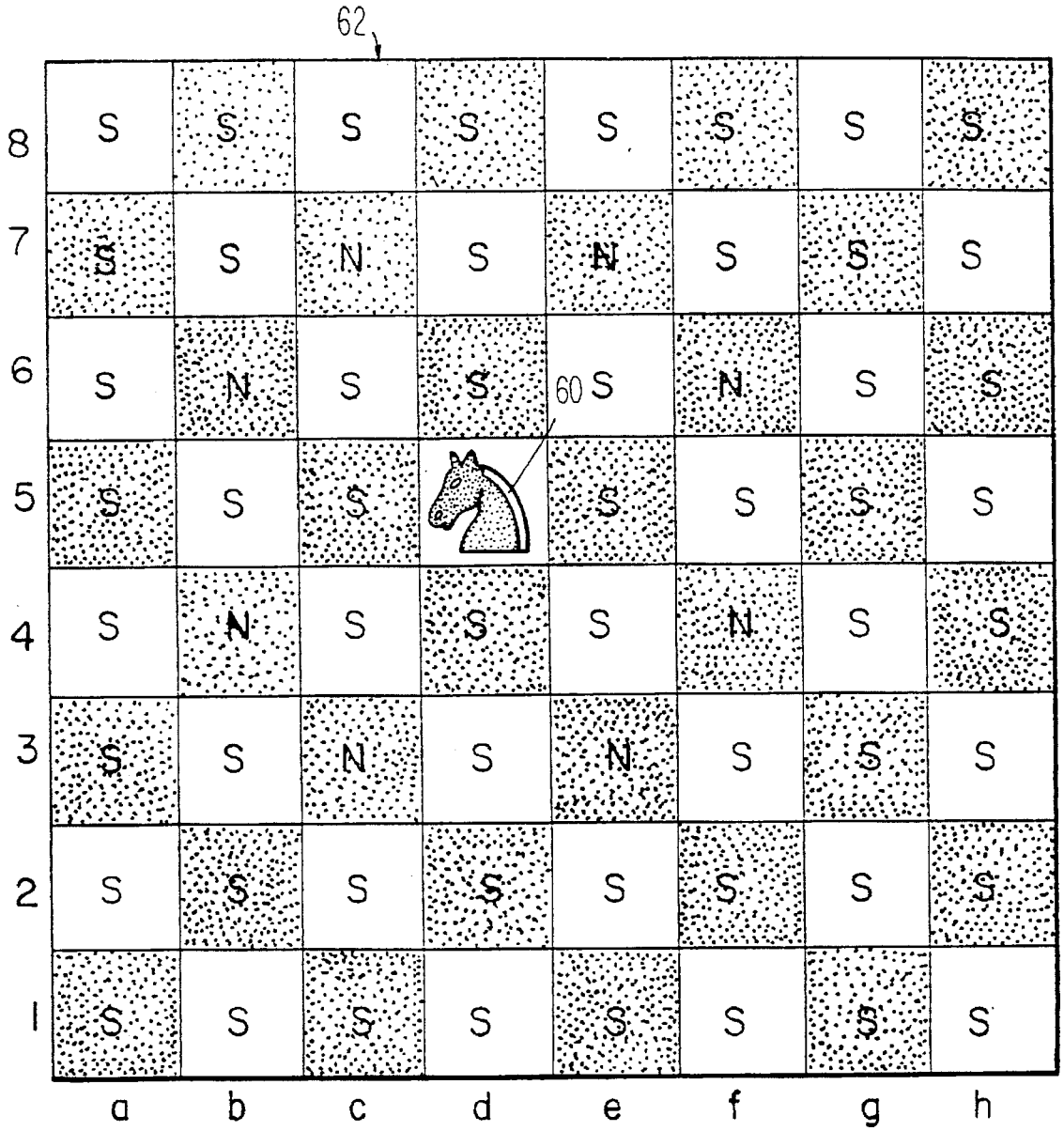
FIG. 7 shows a chess board having magnets incorporated therein to restrict the movement of the knight shown in FIG. 6 only to its permissible moves.

Other North/South pole board configurations may be designed for the unique purpose of teaching a specific piece movement. One such example is shown in FIGS. 6 and 7 and is designed to teach the movement of the knight piece since this movement is often a troublesome move for children and beginners to learn. FIG. 6 shows the knight move in chess. It resembles an L-shape and is two squares in one direction and one square in a perpendicular direction thereto or vice versa. For example, as shown in FIG. 7, from the d5 square, students might be asked to find the 8 squares $64_{1,\ldots,n}$ the knight can move to. FIG. 7 shows the specific North/South magnetic configuration of a chess board that will guide the students to the correct series of moves. A magnet in the base of the knight 60 resting on the d5 square of the board 62 will have a South pole polarity and therefore will be attracted from the d5 square to only those squares the knight may move to, namely squares c7, e7, b6, b4, c3, e3, f4 and f6, denoted $64_1$–$64_8$, respectively. The knight will experience repulsion if any other move is attempted from the d5 square.

From the possible movements of the knight 60 from the central square d5, students will learn another important chess concept, viz., that from a central square, the knight has more mobility than from a flank square, one along the edges of the board 62. The d5 square may be North pole, Multipole or a regular magnetic material in order for the knight to rest on it. Varying board designs will accomplish the same objective for the other chess pieces.

The same concept of providing a magnet in a base of a piece with a certain polarity and providing the magnets in the chess board which underlie possible squares that piece can move to with an opposite polarity facing upward and the magnets in the chess board which underlie squares that piece cannot move to with magnets having the same polarity facing upward can be applied to teach most if not all of the moves in chess.

With respect to the ability to teach weights and measures in conjunction with the game of chess, as shown in FIG. 2, the chess pieces 2, 3, 5, 6, 30, 32, 34, 36 are constructed to have a pre-determined mass. For example, each chess piece can include an interior compartment receivable of a mass of a given weight so that the entire piece has the pre-determined mass. The size of the compartment in each piece depends on the size of the piece and the mass to be inserted therein. The mass inserted into each piece to provide the piece with the predetermined mass is designed to ensure direct correlation of the total weight of that piece to the exchange value of the piece in accordance with accepted convention noted above. This aspect is useful because during chess games between children learning how to play, numerous exchanges of pieces take place often without regard to their exchange values. This is so because children are taught the numerical value of the pieces and are then expected to remember them and calculate in their minds differences between the pieces. This is done in the conceptual and symbolic way.

By appropriately weighting the chess pieces which have an exchange value, i.e., all pieces except for the king, this embodiment of the present invention remedies this situation and avoids uneven exchanges by making the chess pieces weigh proportional to their relative exchange values. In this manner, chess students, with the help of a balance or a scale will figure out the exchange value of the pieces for themselves using the discovery or inquiry method. A visual and hands-on component is added to the learning of the exchange value of the pieces, which will benefit the students in that such skills may then be transferred to other academic areas.

In the convention, the pieces are universally assigned the following numerical values: Queen=9 points; Rook=5 points; Bishop=3 points; Knight=3 points; Pawn=1 point. Since the king in chess may never be captured, it has no exchange value and is usually assigned an infinite value or no value at all. Nevertheless, the king in the chess set in accordance with the present invention should weigh a little more than a queen so as not to give the impression that it is not an important piece should it weigh less than the other pieces. However, the king should not be included with the other pieces when the children are weighing and balancing, and thus learning about weights and measures. The chess pieces will therefore have a gross weight in the ratio of 9:5:3:3:1 respectively, the queen, rook, bishop, knight and pawn. When a balance is achieved, students will see for themselves that an exchange can be made without loss of material, i.e., pieces of equivalent weight and thus value are being exchanged. For example, a knight will balance a bishop (3=3) (as shown by the balanced scale 100 in FIG. 8), or a rook will balance a bishop and 2 pawns (5=3+1+1=5) (as shown by the balanced scale 100 in FIG. 10) and so on. However, a rook will not balance a bishop since it has a larger exchange value and will therefore weigh more (5≠3) (as shown by the unbalanced scale 100 in FIG. 9). Indeed, one may teach fundamentals of algebraic equations using the proportionately weighted chess pieces and the balance. Another added advantage to the weighted pieces is that children will become accustomed to the feel of the heavier pieces such as the queen or rook and will be careful as to their deployments.

The chess pieces do not have to be constructed to have a hollow mass-receiving compartment in which a mass of the desired weight is arranged to provide the gross weight of the chess piece as desired. Rather, it is foreseeable that the pieces can be constructed as a solid structure having a mass in proportion to the other pieces in accordance with the convention, or as pieces with a mass fixedly mounted therein as part of the piece.

The embodiment wherein the chess pieces are provided with a predetermined mass relative to their comparative or exchange value may be used in conjunction with the magnetic chess board and magnetized bishops in the embodiment described above. However, it will be appreciated by those skilled in the art that this embodiment wherein the pieces are weighted according to their comparative value can be used independently of the embodiment including the magnetized chess board and magnetized bishops and/or kings.

The examples provided above are not meant to be exclusive. Many other variations of the present invention would be obvious to those skilled in the art, and are contemplated to be within the scope of the appended claims. For example, although the squares of a standard eight-row by eight-column chess board are magnetized in accordance with the invention, it is within the scope and spirit of the invention that in order to learn the bishop move, another board configuration can be magnetized. For example, a smaller board has been proposed in which each side has only one bishop, one knight and one rook, i.e., only five columns. Such a modified chess board could be magnetized in accordance with the invention by providing magnets underneath the light squares having a North pole facing upward and the bishop with a magnet having a South pole facing downward if that bishop is arranged to move only along the light squares. If not, i.e., the bishop is arranged to move only along dark squares, then the bishop is provided with a magnet having a North pole facing downward to thereby be repelled from the light squares. Thus, the concept of magnetizing a chess board and bishops is not limited to the standard sixty-four square chess board, but rather it is expected that a minimum three-row by three-column modified board is required. Furthermore, with respect to the weighting of the chess pieces relative to their exchange value, it is not required that all the chess pieces in a standard chess set be present in the weighted chess set construction in accordance with the invention in order to enable the ability to learn the exchange values of the pieces. For example, in the modified chess set having only one bishop, one rook and one knight (and thus five pawns) as well as a king and queen, these pieces can be weighted in accordance with the invention in accordance with the convention described above.

I claim:

1. In a chess set having an eight-row by eight-column pattern of sixty four playing squares on a playing surface of a chess game playing board and two sets of visually distinct playing pieces each comprising eight pawns, two knights, two bishops, two rooks/castles, one queen and one king, the sixty four playing squares comprising thirty-two light squares and thirty-two dark squares arranged in an alternating light/dark pattern in each of said rows and each of said columns, the improvement comprising:

a first set of at least one magnet having a North pole and a South pole arranged in connection with said board and underlying said light squares such that the North pole is oriented toward the playing surface, and a second set of at least one magnet having a North pole and a South pole arranged in connection with said board and underlying said dark squares such that the South pole is oriented toward the playing surface, a first one of said bishops of each of said sets movable only on said light squares including a magnet having a North pole and a South pole arranged such that the South pole is oriented toward the playing surface whereby said first bishops attract to said light squares and are repelled from said dark squares, and a second one of said bishops of each of said sets movable only on said dark squares including a magnet having a North pole and a South pole arranged such that the North pole is oriented toward the playing surface whereby said second bishops attract to said dark squares and are repelled from said light squares.

2. The chess set of claim 1, wherein said magnets of said first and second bishops are permanently embedded in said bishops.

3. The chess set of claim 2, wherein said magnets of said first and second bishops are embedded such that a portion of said magnets is flush with a lower exterior surface of said bishops.

4. The chess set of claim 1, wherein said magnets of said first and second bishops comprise a plate attached to a lower surface of said bishops.

5. The chess set of claim 1, wherein said first and second sets of at least one magnet are arranged in an interior of said board.

6. The chess set of claim 1, wherein said first set of at least one magnet comprises a plurality of magnets, each magnet of said plurality of magnets of said first set underlying a respective one of said light squares, and said second set of at least one magnet comprises a plurality of magnets, each magnet of said plurality of magnets of said second set underlying a respective one of said dark squares.

7. The chess set of claim 1, wherein said first and second set of magnets comprise electromagnets, further comprising electricity supply means for polarizing said electromagnets of said first and second set of magnets.

8. The chess set of claim 1, wherein said king of each of said sets comprises a vertical rod magnet having a North pole and a South pole and arranged such that the North pole faces upward, said magnets in said kings having a strength such that said kings repel one another if said kings are placed on adjacent ones of said squares.

9. The chess set of claim 8, wherein said magnets in said kings are placed in an upper portion thereof such that said magnets in said kings do not attract or repel said first and second sets of at least one magnet underlying said squares.

10. The chess set of claim 1, wherein each of said playing pieces has a predetermined mass relative to its exchange value according to the convention whereby a queen has an exchange value of nine, a rook has an exchange value of five, a bishop and knight each has an exchange value of three and pawn has an exchange value of one such that each of said pawns has a unit weight of one, each of said knights and bishops has a weight three times the weight of one of said pawns, each of said rooks has a weight five times the weight of one of said pawns, and each of said queens has a weight nine times the weight of one of said pawns.

11. in a chess set having an eight-row by eight-column pattern of sixty four playing squares on a playing surface of a chess game playing board and two sets of visually distinct playing pieces each comprising eight pawns, two knights, two bishops, two rooks/castles, one queen and one king, the sixty four playing squares comprising thirty-two light squares and thirty-two dark squares arranged in an alternating light/dark pattern in each of said rows arid each of said columns, the improvement comprising:

a first set of at least one magnetizable member arranged in connection with said board and underlying said light squares, a second set of at least one magnetizable member arranged in connection with said board and underlying said dark squares, means for magnetizing said first set of at least one magnetizable member underlying said light squares and said second set of at least one magnetizable member underlying said dark squares such that each of said at least one magnetizable member underlying said light squares has a North pole and a South pole whereby the North pole is oriented toward the playing surface and each of said at least one magnetizable member underlying said dark squares has a North pole and a South pole whereby the South pole is oriented toward the playing surface, a first one of said bishops of each of said sets movable only on said light squares including a magnet having a North pole and a South pole arranged such that the South pole is oriented toward the playing surface whereby said first bishops attract to said light squares and are repelled from said dark squares, and a second one of said bishops of each of said sets movable only on said dark squares including a magnet having a North pole and a South pole arranged such that the North pole is odented toward the playing surface whereby said second bishops attract to said dark squares and are repelled from said light squares.

12. The chess set of claim 11, wherein said first set of at least one magnetizable member comprises a plurality of magnetizable members, each magnetizable member of said plurality of magnetizable members of said first set underlying a respective one of said light squares, and said second set of at least one magnetizable member comprises a plurality of magnetizable members, each magnetizable member of said plurality of magnetizable members of said second set underlying a respective one of said dark squares.

13. The chess set of claim 11, wherein said magnetizing means comprise electricity supply means and at least electrical conductor directly engaging with said first and second sets of at least one magnetizable member.

14. The chess set of claim 11, wherein each of said playing pieces has a predetermined mass relative to its exchange value according to the convention whereby a queen has an exchange value of nine, a rook has an exchange value of five, a bishop and knight each has an exchange value of three and pawn has an exchange value of one such that each of said pawns has a unit weight of one, each of said knights and bishops has a weight three times the weight of one of said pawns, each of said rooks has a weight five times the weight of one of said pawns, and each of said queens has a weight nine times the weight of one of said pawns.

15. In a chess set comprising an eight-row by eight-column pattern of sixty four playing squares on a playing surface of a chess game playing board and two sets of visually distinct playing pieces each comprising eight pawns, two knights, two bishops, two rooks/castles, one queen and one king, the improvement comprising:

each of said playing pieces having a predetermined mass relative to its exchange value according to the convention whereby a queen has an exchange value of nine, a rook has an exchange value of five, a bishop and knight each has an exchange value of three and pawn has an exchange value of one such that each of said pawns has a unit weight of one, each of said knights and bishops has a weight three times the weight of one of said pawns, each of said rooks has a weight five times the weight of one of said pawns, and each of said queens has a weight nine times the weight of one of said pawns.

16. An arrangement for learning movement of a bishop in the game of chess, comprising a chess board having a playing surface defining at least three rows and at least three columns, said playing surfaces including light squares and dark squares arranged in an alternating light/dark pattern in each of said rows and each of said columns, a first set of at least one magnet having a North pole and a South pole arranged in connection with said board and underlying said light squares such that the North pole is oriented toward the playing surface, and a second set of at least one magnet having a North pole and a South pole arranged in connection with said board and underlying said dark squares such that the South pole is oriented toward the playing surface, and a first bishop movable only on said light squares including a magnet having a North pole and a South pole arranged such that the South pole is oriented toward the playing surface whereby said first bishop attracts to said light squares and is repelled from said dark squares.

17. The arrangement of claim 16, further comprising a second bishop movable only on said dark squares including a magnet having a North pole and a South pole arranged such that the North pole is oriented toward the playing surface whereby said second bishop attracts to said dark squares and is repelled from said light squares.

18. The arrangement of claim 16, wherein said at least three rows comprises eight rows and said at least three columns comprises eight columns such that said playing surface includes sixty-four squares, further comprising two sets of visually distinct playing pieces each comprising eight pawns, two knights, two rooks/castles, one queen, one king, said first bishop and said second bishop, the sixty four playing squares comprising thirty-two light squares and thirty-two dark squares arranged in an alternating light/dark pattern in each of said rows and each of said columns.

19. The arrangement of claim 18, wherein each of said playing pieces has a predetermined mass relative to its exchange value according to the convention whereby a queen has an exchange value of nine, a rook has an exchange value of five, a bishop and knight each has an exchange value of three and pawn has an exchange value of one such that each of said pawns has a unit weight of one, each of said knights and bishops has a weight three times the weight of one of said pawns, each of said rooks has a weight five times the weight of one of said pawns, and each of said queens has a weight nine times the weight of one of said pawns.

* * * * *